US005274965A

United States Patent [19]

Jackson

[11] Patent Number: 5,274,965

[45] Date of Patent: Jan. 4, 1994

[54] INVERTING RAIN GUTTER

[75] Inventor: Robert W. Jackson, Alexandria, Va.

[73] Assignee: Gutter-Clean Hinge Company, Alexandria, Va.

[21] Appl. No.: 831,929

[22] Filed: Feb. 6, 1992

[51] Int. Cl.[5] ..... E05D 5/06

[52] U.S. Cl. ..... 52/11; 248/48.2; 52/12; 16/389

[58] Field of Search ..... 52/11, 12, 14, 15, 16; 16/389, 385, 392; 248/48.2, 48.1

[56] References Cited

U.S. PATENT DOCUMENTS

| | | | |
|---|---|---|---|
| 2,890,664 | 6/1950 | Rachlin . | |
| 3,037,767 | 6/1952 | Haynes et al. . | |
| 3,057,117 | 10/1962 | Singer . | |
| 3,077,055 | 2/1963 | Tripp, Jr. . | |
| 3,091,055 | 5/1963 | Hegedusich . | |
| 3,616,582 | 11/1971 | Walek et al. . | |
| 3,630,473 | 12/1971 | Landis . | |
| 3,740,787 | 6/1973 | Bowermaster . | |
| 4,014,074 | 3/1977 | Faye | 16/392 |
| 4,019,290 | 4/1977 | Manty . | |
| 4,036,369 | 7/1977 | Eisenberg | 248/48.2 |
| 4,061,151 | 12/1977 | Ward . | |
| 4,072,285 | 2/1978 | Greenwood . | |
| 4,116,008 | 9/1978 | Ward . | |
| 4,117,635 | 10/1978 | Nelson . | |
| 4,185,420 | 1/1980 | Medland | 52/11 |
| 4,199,121 | 4/1980 | Le Febvre . | |
| 4,253,281 | 3/1981 | Ruttenberg . | |
| 4,309,792 | 1/1982 | Faye . | |
| 4,311,292 | 1/1982 | Deason | 248/48.2 |
| 4,411,108 | 10/1983 | Kerester . | |
| 4,413,449 | 11/1983 | Faye . | |
| 4,446,658 | 5/1984 | Gouin . | |
| 4,561,616 | 12/1985 | Robinson . | |
| 4,610,412 | 9/1986 | Holden . | |
| 4,615,153 | 10/1986 | Carey . | |
| 4,669,232 | 6/1987 | Wyatt . | |
| 4,696,131 | 9/1987 | Schreffler . | |
| 4,741,645 | 4/1988 | Butler | 52/11 |
| 4,745,657 | 5/1988 | Faye | 52/11 |
| 4,813,190 | 3/1989 | Wittig | 52/11 |
| 4,912,888 | 4/1990 | Martin | 52/11 |
| 5,146,718 | 9/1992 | Baskett | 52/11 |
| 5,184,435 | 2/1993 | Sherman | 248/48.2 |

FOREIGN PATENT DOCUMENTS

| | | | |
|---|---|---|---|
| 0296054 | 4/1967 | Australia | 248/48.2 |
| 0060761 | 9/1972 | Australia | 248/48.2 |
| 0703314 | 2/1965 | Canada | 248/48.2 |
| 83/02639 | 8/1983 | World Int. Prop. O. . | |

OTHER PUBLICATIONS

Advanced Systems, Inc., Flier re Tilt-Clean TM Gutter Systems, 07710/ADV, Buyline 2603.

*Primary Examiner*—Carl D. Friedman
*Assistant Examiner*—Wynn Wood
*Attorney, Agent, or Firm*—Foley & Lardner

[57] ABSTRACT

A gutter bracket assembly includes a fascia bracket and a gutter bracket for rotating a gutter to effect cleaning debris therefrom. The fascia bracket including a rear panel adapted to be affixed vertically to a fascia board, a bottom panel extending from the rear panel, and a receiving portion located at an end of the bottom panel remote from the rear panel and including a first pivot member. The gutter bracket includes a frame member having a second pivot member. There is also provided a mechanism for attaching the first pivot member to the second pivot member for permitting rotation of the gutter bracket about the receiving portion of the fascia bracket so that the gutter bracket may be rotated between a first, rain-gathering position and a second, inverted position for emptying water and/or debris from the gutter. The gutter bracket includes a mechanism for securing the gutter to the frame member solely by a snap-fit of a portion of the frame about a portion of the gutter.

9 Claims, 5 Drawing Sheets

INVERTING RAIN GUTTER

BACKGROUND OF THE INVENTION

The invention relates to rain gutters that may be inverted in order to dump accumulated debris.

Since the rain gutter was invented, various attempts have been made to provide a device that would facilitate the cleaning of accumulated debris from gutters. Many of these efforts have centered on rather complicated mechanical linkage systems, examples of which can be found in U.S. Pat. Nos. 4,116,008 and 4,117,635, that are utilized to invert the gutters and cause accumulated debris such as leaves and twigs to fall out. The aforementioned linkage systems, however, are somewhat expensive and generally require the use of a specialized rain gutter. Furthermore, such systems would require much time and effort for installing the devices.

Efforts to reduce the complexity and cost of gutter dumping systems have led to the use of hinged bracket assemblies that permit the gutter to be manually inverted with the use of a long pole-like tool. Examples are seen in U.S. Pat. Nos. 4,309,792; 4,311,292; and 4,669,232. U.S. Pat. No. 4,199,121 discloses an invertible rain gutter that requires force to be applied to a plurality of points in order to accomplish the inversion of the rain gutter.

While some of these systems provide structural simplicity, they require fully equipped professional installers to mount them on buildings, including a portable roll-forming machine to form new gutters from aluminum coil stock at each job site. Then the gutters must be attached to the hinge assemblies with either pop-rivets or nuts and bolts.

Furthermore, in order to function properly, these hinge assemblies require a portion of the hinge (or some form of bracket) to pass across the top of the gutter. Otherwise, the gutter would lack the required longitudinal rigidity provided by the standard sleeved 7" nails, normally used to secure the gutter to the fascia. Such brackets, however, create an obstruction for the free fall of debris when the gutter is inverted in order to empty its contents. (See for example, U.S. Pat. Nos. 4,669,232; 4,311,292, 4,309,792 and 4,014,074).

Other examples of inverting gutters are illustrated in the following U.S. Pat. Nos.: 3,037,767; 4,072,285; 4,561,616; 3,616,582; 4,019,290; and 4,413,449.

SUMMARY OF THE INVENTION

An object of the invention is to provide a method of inverting either new or existing commonly used "K" type gutter trough by the use of a simple and inexpensive hinge.

Another object of the invention is to provide an invertible rain gutter system that can be easily installed in a simple fashion, without special tools; and to provide a method for securing the gutter inside the gutter bracket in an easily executed snap-fit manner, thereby eliminating the complications involved with the need for pop-rivets or nuts and bolts.

A further object of the invention is to provide a simple mounting system which permits easy inversion and return of rain gutters for cleaning them of debris with a manual tool from the ground.

A still further object of the instant invention is to provide a system for holding gutter troughs securely, without obstructions or barriers to the free and complete fall of debris from the gutter, when inverted.

These and other objects of the invention are achieved in a preferred embodiment of the invention by an apparatus having a fascia bracket, with a gutter bracket hinge that serves as a fulcrum point to the fascia bracket, thus forming the gutter hinge assembly. The gutter bracket has a profile shaped to conform to the standard "K" type gutter used commonly throughout the United States.

In accordance with the principles of the invention, a gutter bracket assembly is provided to permit facile cleaning of water and/or debris from rain gutters and to permit facile installation of the gutter bracket to the gutter without any requirement for rivet, screw or the like. The gutter bracket assembly includes a fascia bracket and a gutter bracket for rotating the gutter to effect cleaning debris therefrom. The fascia bracket including a rear panel adapted to be affixed vertically to a fascia board, a bottom panel extending from the rear panel, and a receiving portion located at an end of the bottom panel remote from the rear panel and including a first pivot member. The gutter bracket includes a frame member having a second pivot member. There is also provided a mechanism for attaching the first pivot member to the second pivot member for permitting rotation of the gutter bracket about the receiving portion of the fascia bracket so that the gutter bracket may be rotated between a first, rain-gathering position and a second, inverted position for emptying water and/or debris from the gutter. The gutter bracket includes a mechanism for securing the gutter to the frame member solely by a snap-fit of a portion of the frame about a portion of the gutter.

BRIEF DESCRIPTION OF THE DRAWINGS

With the above as background, reference should now be made to the following figures for a detailed description of the invention.

DETAILED DESCRIPTION OF THE PREFERRED EMBODIMENTS

Figure 1A:
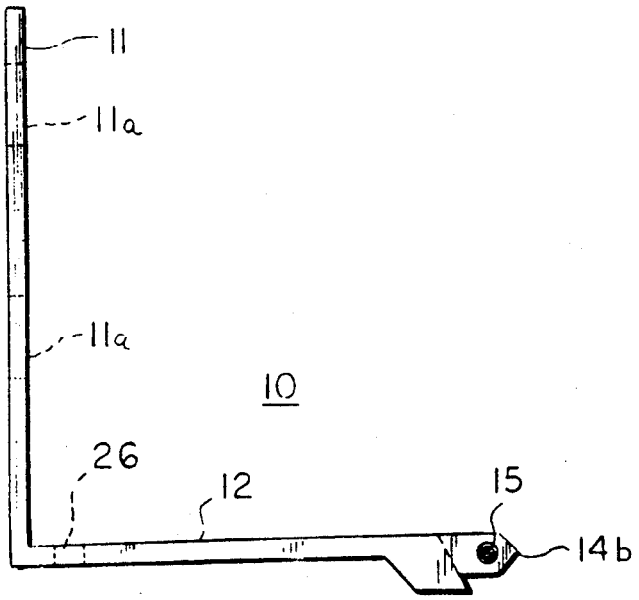
FIG. 1A is a side view of the fascia bracket in accordance with the invention.
Figures 6A, 6B:
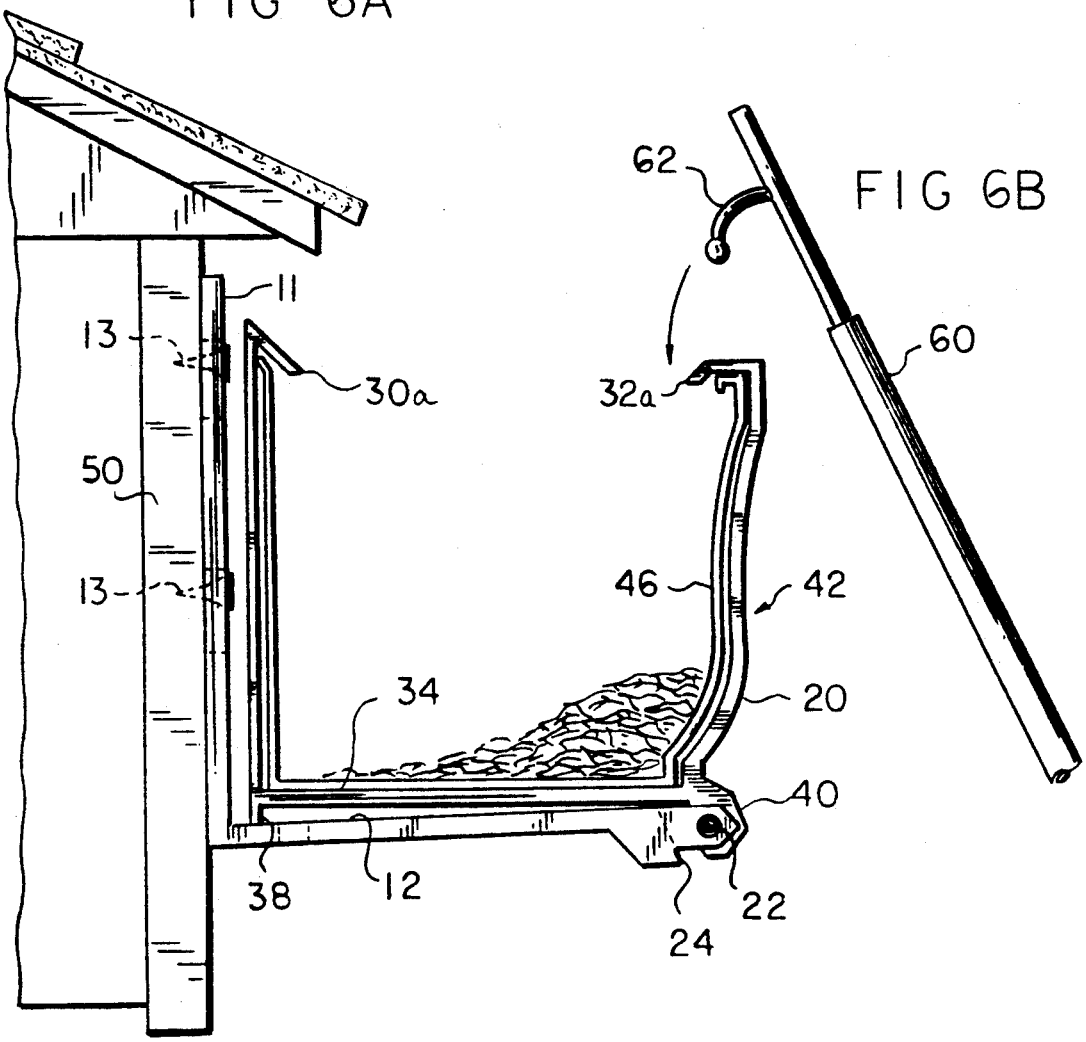
FIG. 6A illustrates the gutter bracket assembly mounted onto a building.
FIG. 6B illustrates an extension pole used to perform an inverting operation of the gutter bracket assembly.
Figure 7:
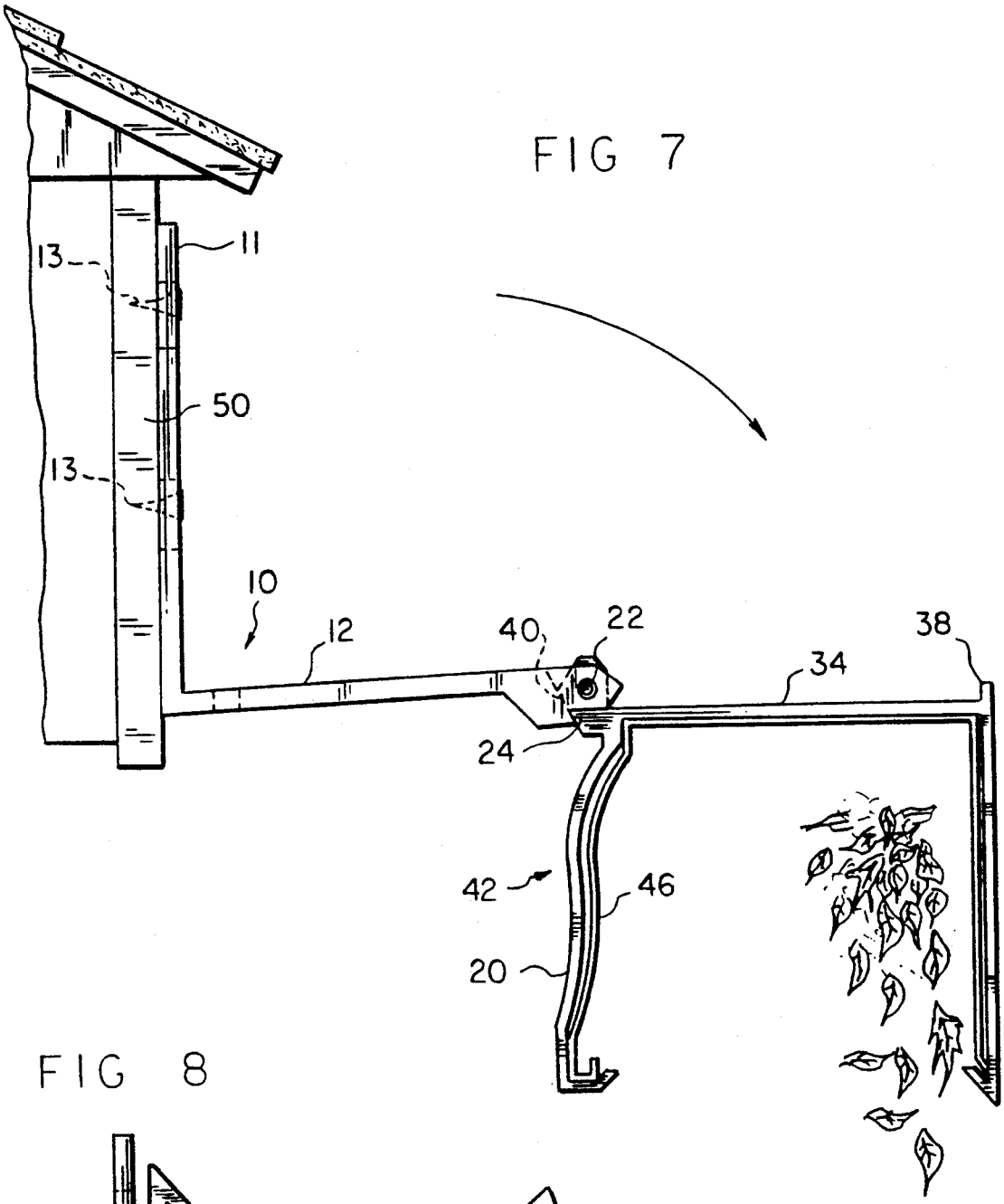
FIG. 7 depicts the gutter bracket assembly in its inverted position.

Referring now to FIG. 1A, a facia bracket 10 of the present invention, having a generally L-shaped configuration, is comprised of a vertical rear panel 11, and a substantially horizontal bottom panel 12 joined to rear panel 11 at the lower most extremity thereof. The rear panel 11 of the bracket 10 is shown as containing two openings 11*a* for screws 13 (shown in phantom in FIG. 6A) used to attach fascia bracket 10 to the structural fascia of buildings. The distal end of the bottom panel 12 of fascia bracket 10 is configured to include a receiving portion formed in part by a first pivot member which includes two support arms 14*a*, 14*b* which have openings 15 therein and which support a hinge pin 22. A second pivot member is formed by a hinge part 18 of a gutter bracket 20 (FIG. 2A) which is supported on the hinge pin 22 between the arms 14*a*, 14*b* of the bottom panel 12. The hinge pin 22 is typically cylindrically shaped and provides the means for attaching the first pivot member to the second pivot member for permitting rotation of the gutter bracket 20 about the distal end of the bottom panel 12. Thus, the gutter bracket 20 may be pivoted about the hinge pin 22 between a rain-gathering position as shown in FIG. 6A, and an inverted position as shown in FIG. 7.

A stop member 24 of the bottom panel 12 is configured to act as a support stop for limiting the rotation of the gutter bracket 20 as will be described infra. The hinge pin 22 defines a beveled opening 26 between the pin 22 and the stop member 24 as illustrated in FIG. 1A and 1B.

As seen in FIG. 1A, the bottom panel 12 is set at a gradient to provide water drainage sufficient to reduce the potential of ice accumulation. A drainage hole 26 is provided in the bottom panel 12 to permit water drainage and thus hinder ice formation in cold weather.

Figure 1C:
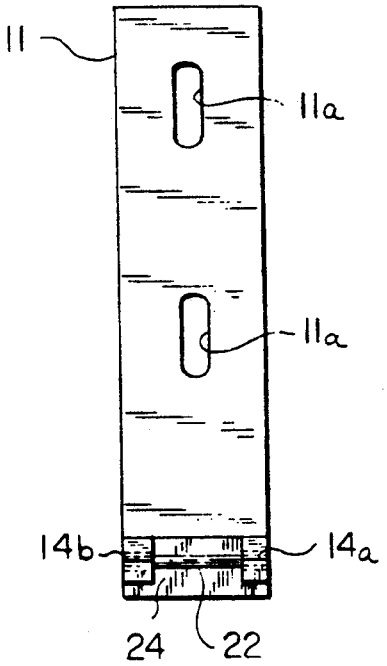
FIG. 1C is a front view of the fascia bracket.
Figure 1B:
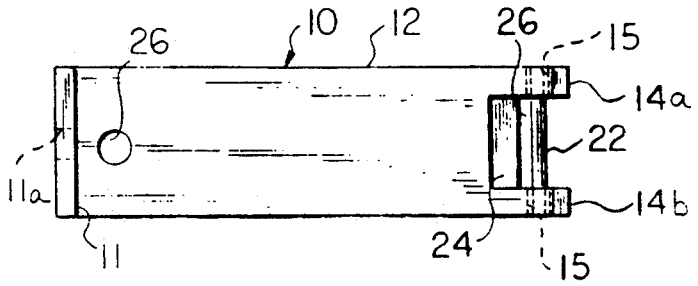
FIG. 1B is a partial top view of the fascia bracket.

FIG. 1B shows a top view of the fascia bracket 10. The view displays the bottom panel 12 of the bracket 10 and the beveled support stop member 24. Further, FIG. 1C shows a front view of the fascia bracket 10, thus displaying the vertical rear panel 11 and the openings 11*a* which are elongated to allow for minor adjustments in the corresponding level of each bracket 10 after being attached to a particular structure fascia with nails or screws. Hinge pin 22 is also illustrated.

Figure 2A:
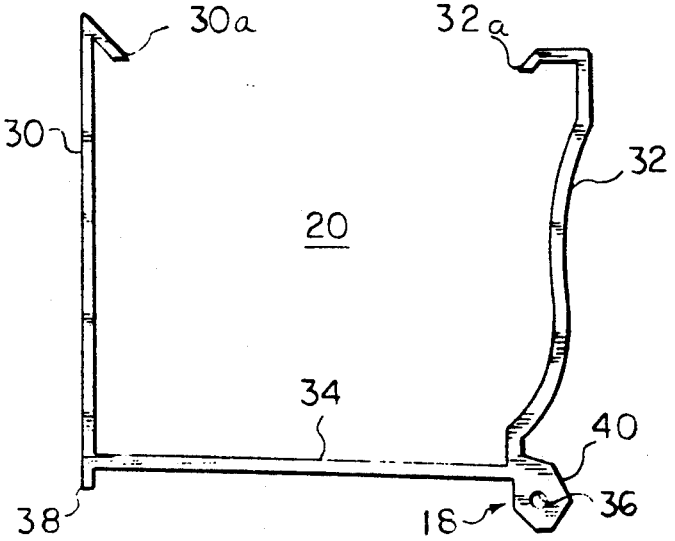
FIG. 2A shows a side view of the gutter bracket.

Referring now to FIG. 2A, the gutter bracket 20 of the present invention is shown from a side view. The gutter bracket 20, includes a frame member having a back leg 30, front leg 32, and bottom member 34. The profile of the gutter bracket 20 conforms to the profile of the "K" type gutter commonly in use today. The upper portions or extremities of the back leg 30 and front leg 32 of bracket 20 are provided with retaining lips 30*a* and 32*a* respectively for securing a gutter within the bracket 20. The retaining lips 30*a*, 32*a* are configured in a manner to have a snap-fit over the upper edges of the gutter so as to require no additional fasteners for securing the gutter to bracket 20. The lower front portion of bracket 20 is further provided with the hinge part 18 which forms an outwardly extending protrusion. Hinge part 18 contains an opening 36 which receives the hinge pin 22, and further contains a stop surface 40 which abuts against the stop member 24 of the bottom portion 12 to limit rotation of the gutter bracket 20 to about 180 degrees when inverting the gutter, e.g., to prevent rotation beyond the inverted position as shown in FIG. 7.

The back leg 30 of the gutter bracket 20 is further provided with an extension 38 which permits the bottom member 34 of the gutter bracket 20 to be maintained substantially horizontal when the gutter bracket 20 is in its normal rain-gathering position. This extension 38 rest against the angled bottom panel 12 of the fascia bracket 10 as illustrated in FIGS. 3 and 5B.

Figure 2B:
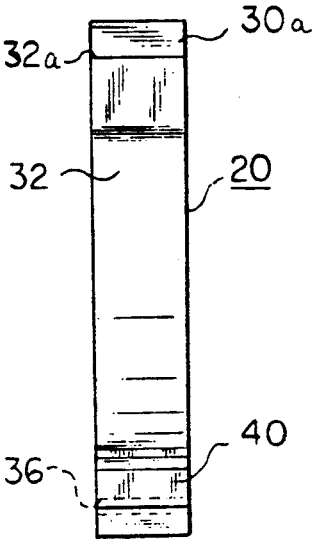
FIG. 2B illustrates a front view of the gutter bracket.

FIG. 2B shows a front view of the gutter bracket 20. It should be noted that gutter bracket 20 has a more narrow width than the fascia bracket 10 so that the hinge part 18 of gutter bracket 20 may fit between the arms 14*a*, 14*b* of the bottom panel 12.

Figure 3:
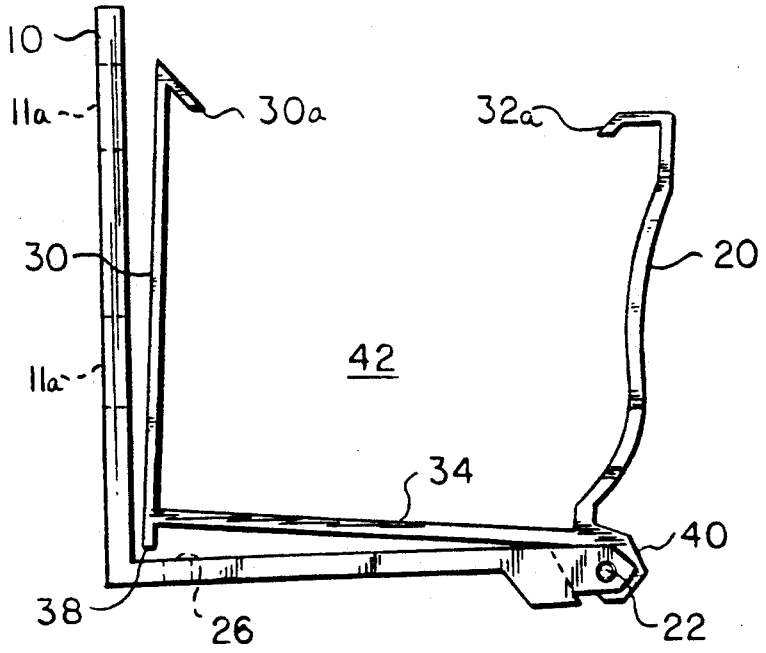
FIG. 3 is a side view of the gutter bracket assembly which includes the fascia bracket of FIGS. 1A–1C and the gutter bracket of FIGS. 2A–2B.

FIG. 3 illustrates the gutter bracket assembly 42 formed from the fascia bracket 10 and the gutter bracket 20. Hinge pin 22 is inserted into the assembly after the gutter bracket 20 is positioned between the arms 14*a*, 14*b* of the bottom panel 12. The hinge pin 22 may have a longitudinal slot to permit spring-like resilience and may be press fit into the opening 36 of hinge part 18 of gutter bracket 20. The openings 15 of the arms 14*a*, 14*b* have a larger diameter than the opening 36 of hinge part 18 to permit the hinge pin 22 to pass therethrough to be press-fit into the aperture 36 of the hinge part 18.

Figure 4A:
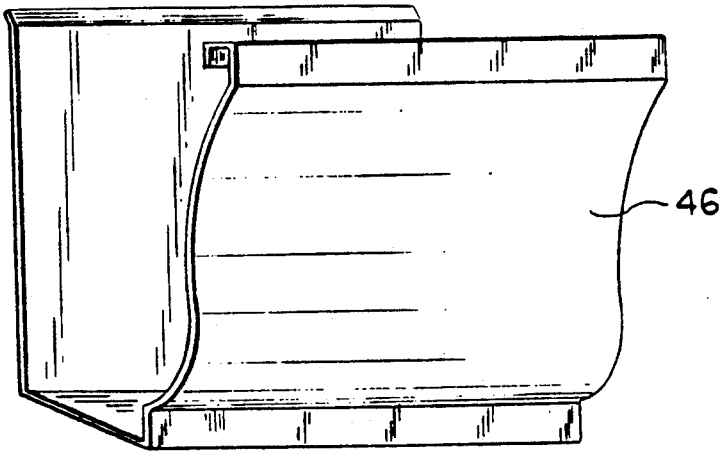
FIGS. 4A and 4B illustrate a conventional "K" type gutter.
Figure 4B:
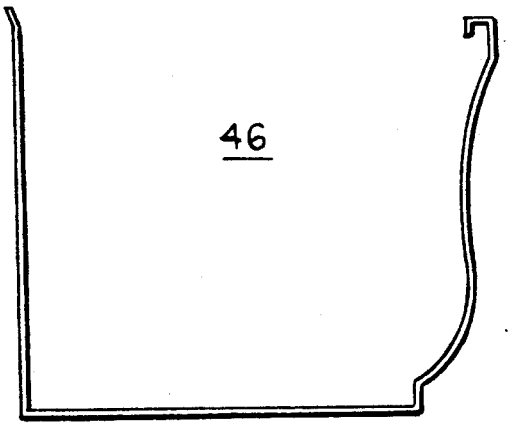

FIGS. 4A and 4B show perspective and end views of a "K" type gutter 46 commonly used on residential dwellings throughout the United States for both sectional and seamless gutters. As may be appreciated by those of ordinary skill in the art, the outward profile and particular dimensions of "K" type gutters formed on roll forming machines made by different manufacturers are inconsistent. However, the present invention is designed to accommodate these variations. It has been further found to be beneficial to affix the gutter bracket assemblies 42 at intervals of approximately four feet, having one gutter bracket assembly 42 at each end of a running gutter section, in order to provide sufficient longitudinal rigidity and overall support for the gutter 46.

Figure 5A:
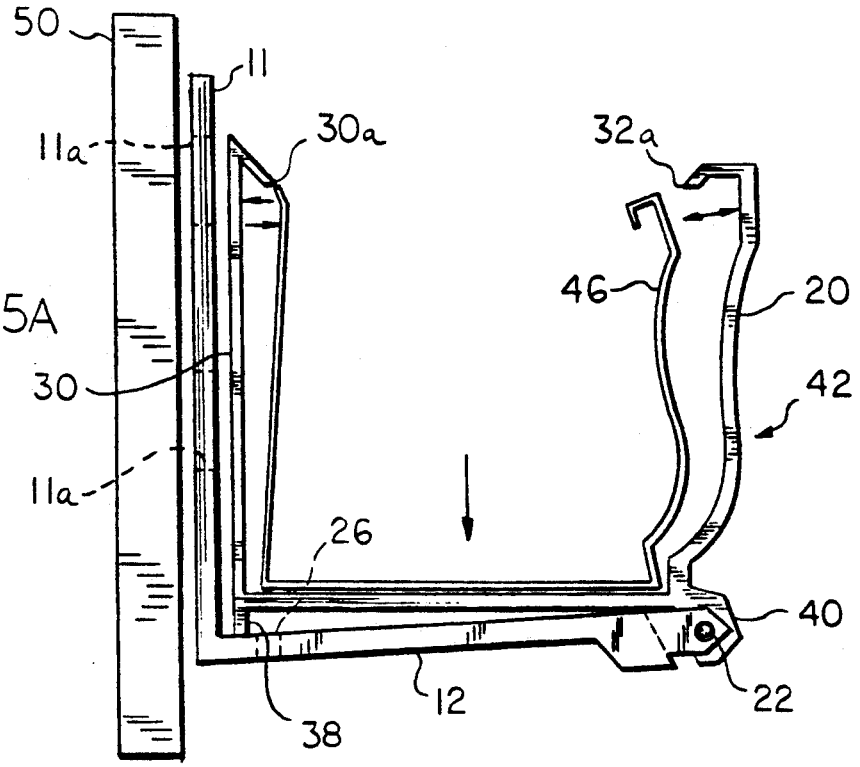
FIGS. 5A and 5B show the snap-fit mounding of the gutter to the gutter bracket within the gutter bracket assembly.
Figure 5B:
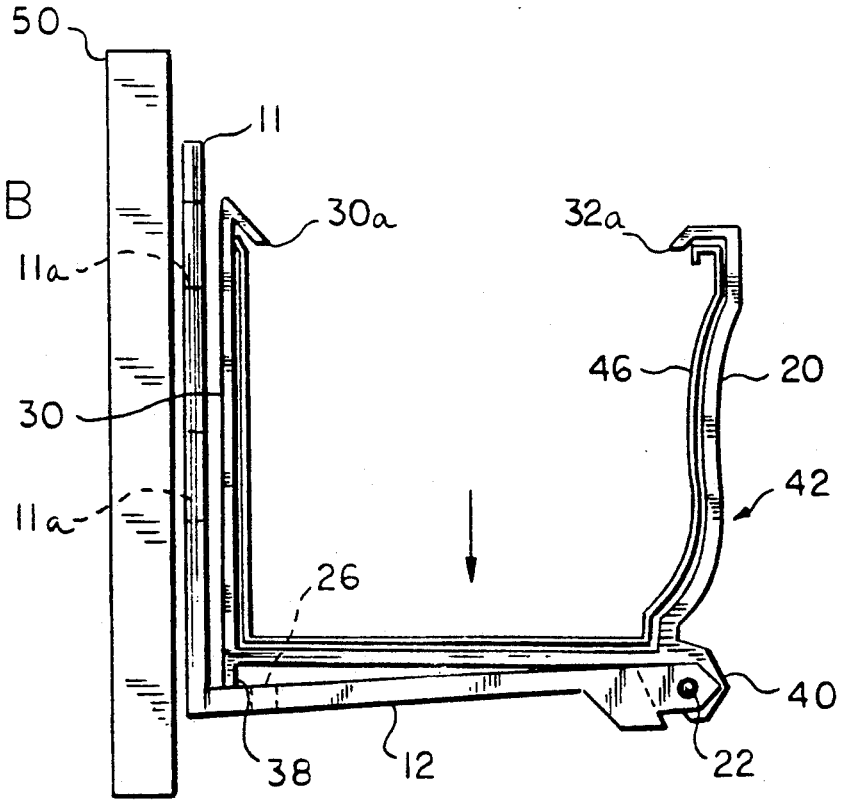

Referring now to FIGS. 5A and 5B, there is shown the manner in which the gutter 46 is installed in the gutter bracket assembly 42. After having secured the gutter bracket assemblies 42 to the fascia board 50 of a house or building at approximately four foot intervals, either new or existing gutter 46 is placed above the gutter bracket assemblies 42 as illustrated. As gutter 46 is forced downward by hand pressure, the vertical members of the gutter 46 are forced inwardly until immediately before the bottom of the gutter 46 meets the bottom of the gutter bracket 20. At this moment, the retaining lips 30*a*, 32*a*, of the gutter bracket 20 have exceeded the height of gutter 46, allowing the vertical gutter members to return to their normal position, thereby enclosing and holding gutter 46 securely within gutter bracket 20 solely by the snap-action of the gutter cooperating with the retaining lips 30*a*, 30*b* of the gutter bracket.

Referring now to FIG. 6A, the gutter bracket assembly 42 of the present invention is shown in the rain-gathering position as it would be for normally collecting water and debris.

FIG. 6B illustrates an adjustable length pole 60 having a hook 60 at the end thereof. The operator uses this pole to manually invert a section of the gutter 46 up to 40 feet in length, emptying it of water and debris, and returning the gutter 46 to its normal position. The operator accomplishes this by causing cook 62 to overlap the outer edge of the gutter 46 at any point along such length, and pulling downwardly. The operator returns the gutter 46 to its normal position by placing the top section of the hook 62 against the rear edge of the gutter 46 and applying upward pressure. Due to the distance of the hinge pin 22 from the fascia board 50, the rotating parts of the instant invention, is after having been moved approximately half way through the arc of motion, will fall by their own weight into either the inverted or normal positions. When inverting a gutter containing water and debris, it has been found advantageous for the operator to stand at a triangular distance of about 45 degrees from the gutter in order to remain in a pristine state.

Referring now to FIG. 7, the gutter bracket assembly enclosing a gutter 46 is shown in a second or fully inverted position achieved after being rotated about hinge pin 22 from the rain-gathering position as described supra. Considerable bouncing motion is caused when the stop member 24 of fascia bracket 10 strikes the angled stop surface 40 of the gutter bracket 20, which is intended to help loosen debris accumulated in the gutter.

Figure 8:
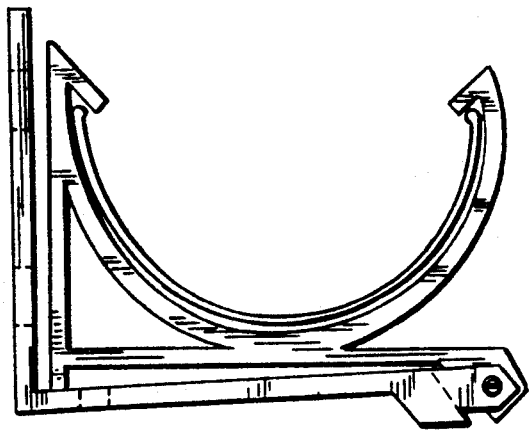
FIG. 8 illustrates an alternate embodiment of the invention in which a half-round type gutter is employed.

FIG. 8 illustrates a composite hinge system modified in shape only to accommodate a half-round type of gutter trough.

In an alternate embodiment of the invention, the stop member 24 and the stop surface 40 may be omitted so that the gutter bracket 20 rotates fully about the hinge pin 22, the rotation being stopped by the gutter contacting the fascia board 50 or other part of the building.

In yet another embodiment of the invention, the bottom panel 12 need not be positioned at an acute angle with respect to the rear panel 11, but may be substantially perpendicular thereto. In this embodiment, the extension 38 is omitted to maintain the bottom member 34 of the gutter bracket 20 substantially horizontal in the rain-gathering position of the assembly 42.

Although the present invention has been shown and described with a particular example of preferred embodiments thereof, it should be understood by those skilled in the art that various other changes and modifications in the form and detail thereof may be made therein without departing from the spirit and scope of the invention.

What is claimed is:

1. A gutter bracket assembly for rotating a gutter to effect cleaning debris therefrom, comprising:

(a) a fascia bracket including:

(1) a rear panel adapted to be affixed vertically to a fascia board, (2) a bottom panel extending from the rear panel, and (3) a receiving portion located at an end of said bottom panel remote from said rear panel and including a first pivot member, (b) a gutter bracket including a frame member having a second pivot member, (c) means for attaching said first pivot member to said second pivot member for permitting rotation of said gutter bracket about said receiving portion of said fascia bracket so that said gutter bracket may be rotated between a first, rain-gathering position and a second, inverted position for emptying water and/or debris from said gutter, and (d) said gutter bracket having a configuration approximately matching that of said gutter, and being generally concave upwardly and open in the rain gathering position, and (e) said gutter bracket including means for securing said gutter to said frame member solely by a snap-fit of a portion of said frame about a portion of said gutter.

2. A gutter bracket assembly as recited in claim 1, wherein said gutter bracket includes:

(a) a back leg, positioned substantially vertically when said gutter bracket is positioned in said rain-gathering position, said back leg having an upper portion, (b) a bottom member, connected at a substantially right angle to said back leg, said bottom member positioned substantially horizontally, when said gutter bracket is positioned in said rain-gathering position, (c) a front leg, connected at a substantially right angle to said bottom member, said front leg positioned substantially vertically when said gutter bracket is positioned in said rain-gathering position, said front leg having an upper portion, and wherein said means for securing said gutter to said frame member includes retaining lip members formed on the upper portions of said front and back legs.

3. A gutter bracket assembly as recited in claim 2, wherein said bottom panel is secured to said rear panel at an acute angle with respect thereto and wherein said back leg of said gutter bracket contains an extension, extending below said bottom member and resting on said bottom panel of said fascia bracket when said gutter bracket is positioned in said rain-gathering position, wherein said bottom member is positioned in a substantially horizontal position when said gutter bracket is positioned in said rain-gathering position.

4. A gutter bracket assembly as recited in claim 3, wherein said bottom panel contains an aperture positioned at a region of said bottom panel adjacent said rear panel for permitting drainage of water therethrough.

5. A gutter bracket assembly as recited in claim 1, wherein said first pivot member includes first and second arm members each having an aperture therethrough, and wherein said second pivot member includes a hinge part having an aperture therethrough, said means for attaching including a hinge pin extending through the aperture in said hinge part and at least partially through the apertures in said first and second arm members.

6. A gutter bracket assembly as recited in claim 2, wherein said first pivot member includes first and second arm members each having an aperture therethrough, and wherein said second pivot member includes a hinge part having an aperture therethrough, said means for attaching including a hinge pin extending through the aperture in said hinge part and at least partially through the apertures in said first and second arm members.

7. A gutter bracket assembly as recited in claim 3, wherein said first pivot member includes first and second arm members each having an aperture therethrough, and wherein said second pivot member includes a hinge part having an aperture therethrough, said means for attaching including a hinge pin extending through the aperture in said hinge part and at least partially through the apertures in said first and second arm members.

8. A gutter bracket assembly as recited in claim 1, wherein said receiving portion of said fascia bracket contains a stop member and wherein said hinge portion of said gutter bracket contains a stop surface, said stop surface contacting said stop member for preventing further rotation of said gutter bracket beyond said inverted position.

9. A gutter bracket assembly as recited in claim 2, wherein said receiving portion of said fascia bracket contains a stop member and wherein said hinge portion of said gutter bracket contains a stop surface, said stop surface contacting said stop member for preventing further rotation of said gutter bracket beyond said inverted position.

* * * * *